US006827089B2

(12) United States Patent
Lee et al.

(10) Patent No.: US 6,827,089 B2
(45) Date of Patent: Dec. 7, 2004

(54) HAIR BRAIDER AND AN AUXILIARY DEVICE THEREOF

(75) Inventors: Myun Woo Lee, 1-206, Gyojikwon Apt., 30, Kusan-dong, Bupyung-gu, Incheon (KR), 403-120; Sun Ki Jun, Incheon (KR); Chang Kyu Cho, Seoul (KR); Jung Sun Yoon, Seoul (KR); Chool Yong Song, Seoul (KR)

(73) Assignee: Myun Woo Lee, Seoul (KR)

( * ) Notice: Subject to any disclaimer, the term of this patent is extended or adjusted under 35 U.S.C. 154(b) by 433 days.

(21) Appl. No.: 10/101,117

(22) Filed: Mar. 20, 2002

(65) Prior Publication Data

US 2002/0092540 A1 Jul. 18, 2002

Related U.S. Application Data

(62) Division of application No. 09/720,269, filed on Jan. 10, 2001, now Pat. No. 6,520,187.

(30) Foreign Application Priority Data

Jan. 28, 2000 (KR) ..... 00-4184
Jun. 15, 2000 (WO) ..... PCT/KR00/00634

(51) Int. Cl.[7] ..... A45D 7/02; A45D 2/00
(52) U.S. Cl. ..... 132/212; 132/265
(58) Field of Search ..... 132/212, 265, 132/270, 245

(56) References Cited

U.S. PATENT DOCUMENTS 4,307,737 A * 12/1981 Shipman ..... 132/223

* cited by examiner

*Primary Examiner*—Todd E. Manahan
*Assistant Examiner*—Robyn Kleu Doan
(74) *Attorney, Agent, or Firm*—Piper Rudnick LLP

(57) ABSTRACT

This invention relates to a hair braider and its auxiliary device, which are portable and braids three bunches of hair into a strand. The hair braider has a substantially figure '8'-configured cam track allowing three carriers to move along the cam track for a '8' track motion. Three carriers combined detachably with three grabbing members accommodating three bunches of hair therein travels along the cam track as a couple of rotors rotate in opposite direction. While three hair grabbing member held on the holders of the carriers conduct the figure '8' motion, three bunches of hair in three hair grabbing members are braided into one strand.

6 Claims, 5 Drawing Sheets

HAIR BRAIDER AND AN AUXILIARY DEVICE THEREOF

This is a divisional application of prior application Ser. No. 09/720,269 filed Jan. 10, 2001 now U.S. Pat. No. 6,520,187.

1. TECHNICAL FIELD

The present invention relates to a hair braider and its auxiliary device and, more particularly, to an improved hair braider which is portable and weaves three bunches of hair into one braid.

2. BACKGROUND ART

Usually, hair is manually braided by a person other than the one who wants to obtain the hair style of dreadlocks. This braiding work takes extremely long time and costs too much. Also, the quality of such manually-braided hair style depends on the worker's skill totally, so that it may not be uniform.

As shown in the U.S. Pat. No. 4,427,017 to Eronimi, an automatic hair braiding device has been developed to save hair braiding time. In the Eronimi's device, a rudder device moves along a figure '8'-shaped track to accomplish the figure eight track motion, which is essential for hair braiding operation. A rudder section has a slot therein, which receives two paddle elements circulating in opposite directions and enables a rudder device moves from a half of the figure '8'-shaped track to the other at the intersection point or area of the track.

In the Eronimi invention, to move from one track to the other track, the rudder section should smoothly receive another paddle element into its slot at the entry position in the crossover area and should be receiving two paddle elements in a slot while it passes through the crossover area, and release one of the two paddle elements at the exit in the crossover area.

However, the above mentioned invention does not smoothly operate at the crossover area because of the mechanical shock caused by the engagement and disengagement between the paddle element and the slot of rudder section. Even though the slot is wider to weaken the mechanical shock, it would not smooth the track changing operation because of wider clearance between the slot and the paddle element.

3. DISCLOSURE OF INVENTION

It is an object of the present invention to provide a hair braider conducting a smooth figure eight track motion to braid hair.

To achieve the above object, the invention comprises a housing containing an electric motor therein and a motor switch installed on the sidewall, a gear box mounted on the upper face of the housing and having a guide plate with an opening formed in a substantially figure eight shape by two intersecting circular openings, a pair of cams mounted on the upper ends of shafts in the center of each circular opening, each defining an annular cam track of a predetermined width with the inner sidewall of the circular opening, a pair of rotors, which is mounted on each top of the shafts, being rotated in opposite directions by the motor, a plurality of carriers disposed slidably in the cam track and conducting a '8' track motion along the cam track according to the rotation of the rotors, and a plurality of hair grabbing members combinable with the carriers, each traveling with the carrier with a bunch of hair accommodated therein. As the hair grabbing members mounting on the carriers travel along the cam track by the rotors rotating in opposite directions, a plurality of bunches of hair accommodated in the hair grabbing members are braided into one strand.

As this invention enables hair to be braided uniformly by conducting '8' track motion smoothly, time and cost for the hair braiding work can be reduced remarkably. Even a non-skilled operator can obtain a uniformly-braided hair. Furthermore, this invention is portable, anyone can easily braid his or her hair by himself or herself.

4. BRIEF DESCRIPTION OF DRAWINGS

The accompanying drawings, which are included to provide a further understanding of the invention, illustrate the preferred embodiment of this invention, and together with the description, serve to explain the principles of the present invention.

5. MODES FOR CARRYING OUT THE INVENTION

Figure 1A:
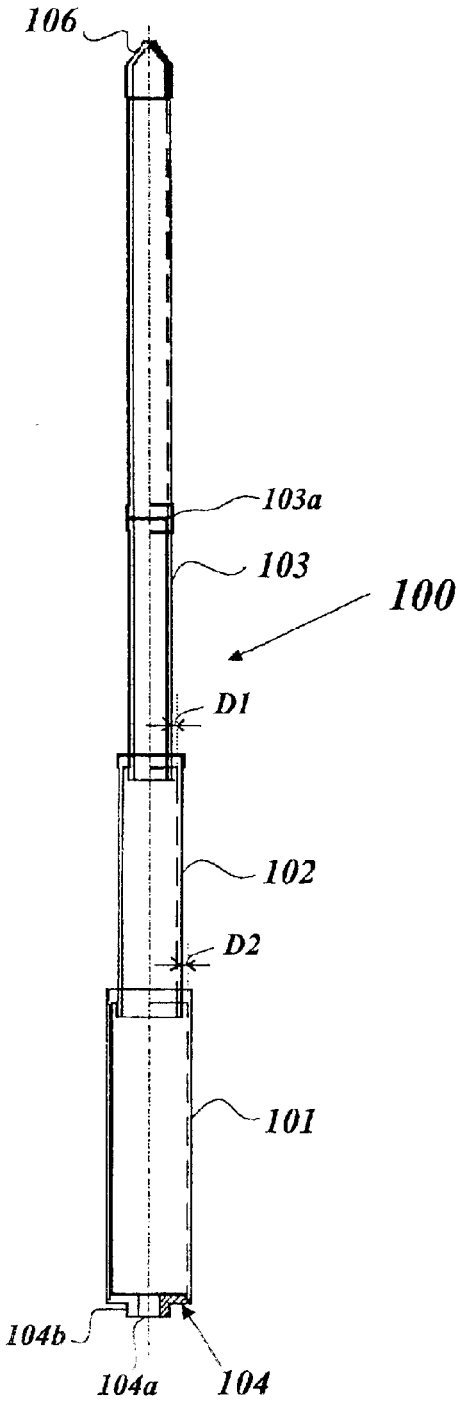
FIG. 1A is a longitudinally sectional view of an extended hair grabbing tube assembly, which is an auxiliary device for the braider.

Referring now to the drawings, a preferred embodiment of the present invention will be described. A hair braider according to the present invention comprises three hair grabbing members 100 configured as FIGS. 1A and 1B, each accommodating a bunch of hair, and a driving member 200 shown in FIG. 2 for moving the three hair grabbing members 100 along a predetermined '8'-shaped cam track.

Figure 2:
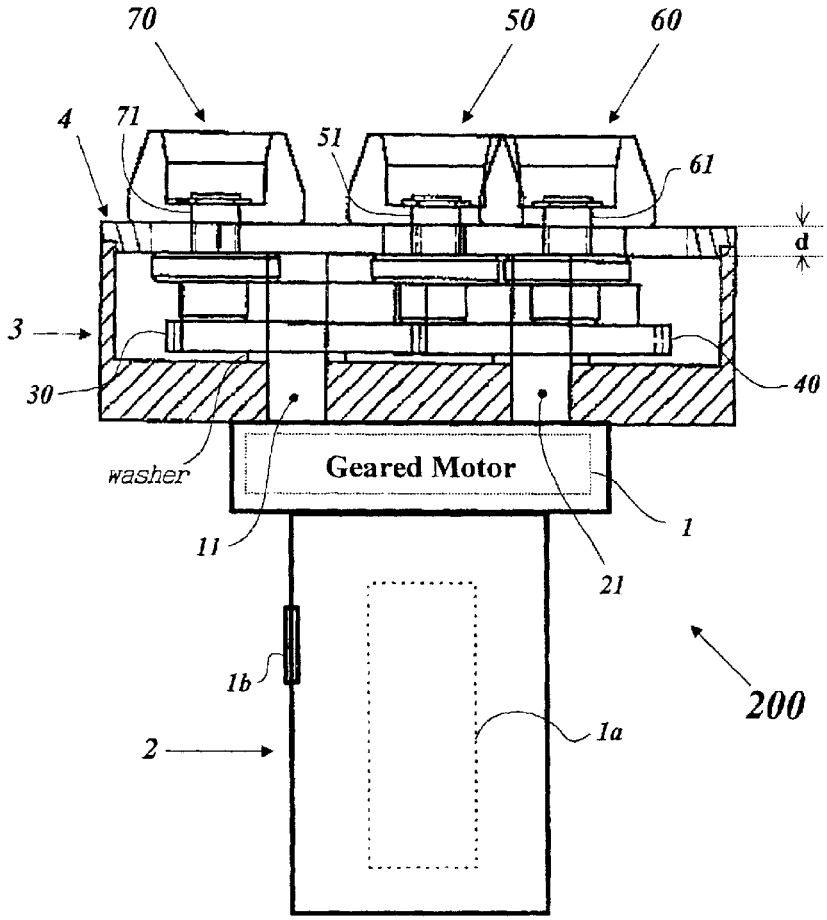
FIG. 2 is a partially sectional view of the hair braider according to the present invention.

As shown in FIG. 2, the driving member 200 comprises a housing 2 containing an electric geared motor 1 and a battery 1*a* therein. A switch 1*b* for turning on or off the motor 1 is installed on the sidewall of the housing 2. A gear box 3 is mounted on the top of the housing 2.

Figure 3:
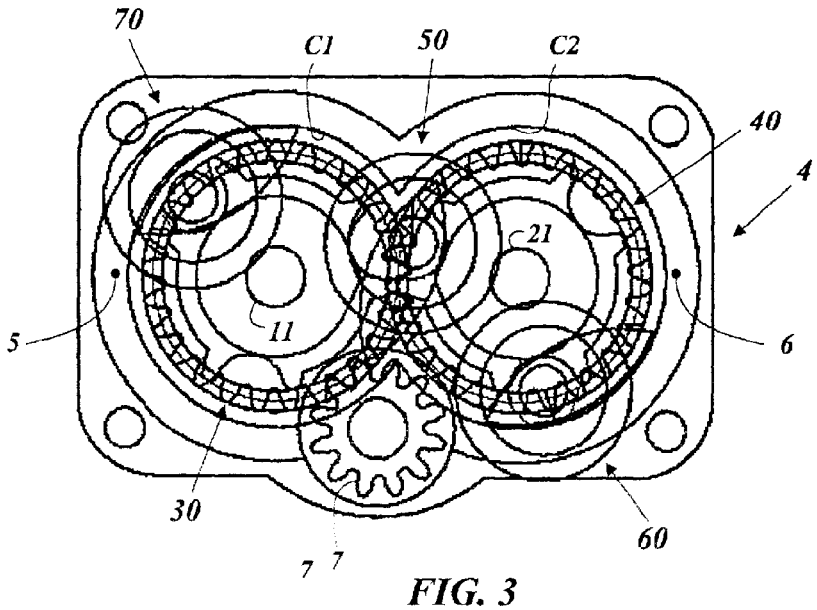
FIG. 3 is a top plan view of the hair braider.

As shown in FIG. 3, on the top of the gear box 3 is bolted a guide plate 4 having a figure eight opening formed by the intersection of two circular openings C1 and C2. At each center of the circular openings C1 and C2 is disposed two shafts 11 and 21 fixed on the bottom surface of the gear box 3. On the upper end of both shafts 11 and 21 are fixed substantially-circular cams 12 and 22, of which the circumferences form two annular cam tracks 5 and 6 with the inner sidewalls of the circular openings C1 and C2.

Figure 4:
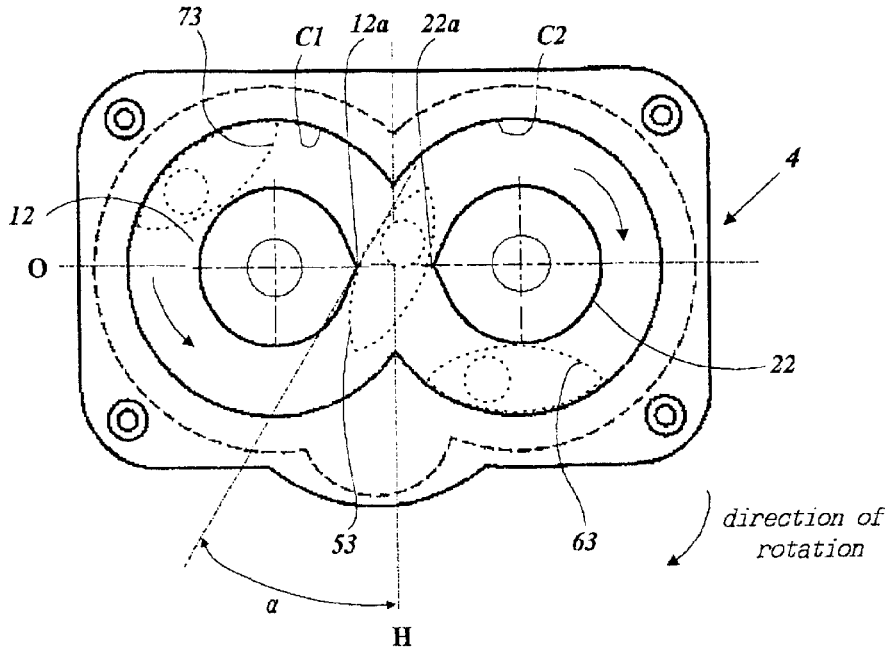
FIG. 4 is a top plan view of a gear box shown in FIG. 2 to show a mechanism for track motion.

As shown in FIG. 4, both cams 12 and 22 include protrusions 12*a* and 22*a*, each protrusion being radially extended outwardly from the outer surface of each cam. The protrusions are opposed to each other on the centerline 'O' of the two cams 12 and 22. Each protrusion 12*a* (22*a*) is dimensioned so that its tangent is inclined at about 23 degrees to the imaginary line 'H' joining two intersection points of two circular openings C1 and C2, and its height is to be about 1/16 as to outer diameter of the cam 12 (22).

Figure 5:
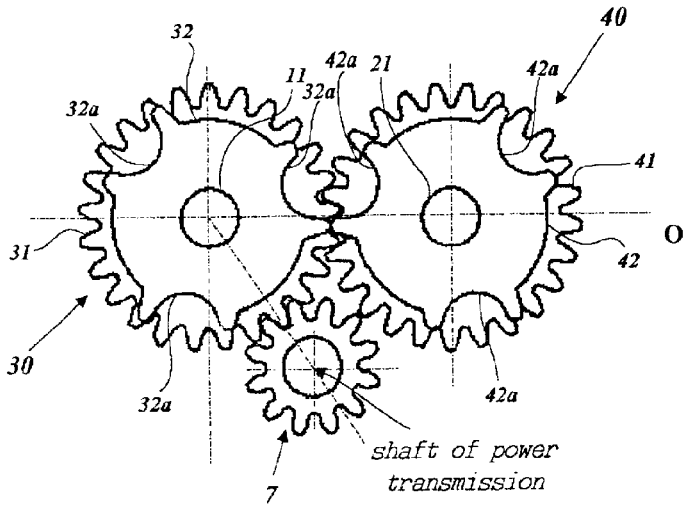
FIG. 5 is a top plan view of arrangement for driven gears and fingers as parts for a motion transmission.

As shown in FIG. 2, a pair of identical rotors 30 and 40 are mounted rotatably on the two shafts 11 and 21, respectively. The rotors 30 and 40 are meshed each other and rotate in opposite directions by means of the motor 1 to give a track motion to all carriers to be described hereinafter. As shown in FIG. 5, each of the rotors 30 and 40 comprises a driven gear 31 (41) mounted rotatably on the shaft 11 (21), and a finger 32 (42) which is formed in one body coaxially on the driven gear 31 (41) and has tree recesses 32*a* (42*a*) equally spaced on its periphery.

The driven gears 31 and 41 are identical and meshed each other to rotate in opposite directions. One of the driven gears 31 and 41 is meshed with a driving gear 7 which is connected to a shaft of the motor 1 through a reduction gear. Therefore, the motor 1 drives the driven gears 31 and 41 in a reduced speed in opposite directions.

As shown in FIG. 5, the rotor 30 (40) is disposed coaxially in the center of the circular opening C1 (C2) and arranged in such a manner that when the two opposed recesses 32*a* and 42*a* meet they form a substantially full circle.

As shown in FIGS. 2 and 3, the hair braider according to the present invention includes three carriers 50, 60, and 70, which are carried by the recesses 32*a* and 42*a* of the fingers 32 and 42 selectively and travel along the cam tracks 5 and 6 formed in the guide plate 4.

Figure 6:
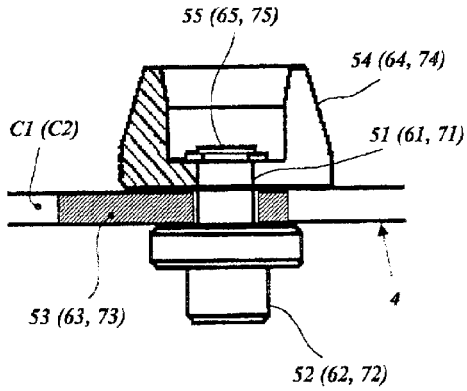
FIG. 6 is a partially sectional side view of a carrier mounted on a guide plate.

As shown in FIGS. 2 and 6, the carrier 50 (60, 70) comprises a cam roller 52 (62, 72) which is fixed on the lower end of a carrier shaft 51 (61, 71) and seated in one of the recesses 32*a* (42*a*) of the finger 32 (42), a rudder 53 (63, 73) having a through hole 53*a* (63*a*, 73*a*) into which the carrier shaft 51 (61, 71) is inserted above the cam roller 52 (62, 72), and a holder 54 (64, 74) connected at the upper end of the carrier shaft 51 (61, 71) through screw combination. The holder 54 (64, 74) has a recessed pocket for receiving and detachably holding the hair grabbing member 100 therein.

Figure 7:
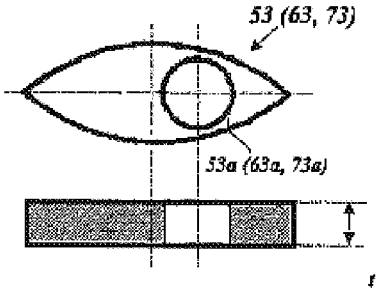
FIG. 7 is a plan view and a sectional side view of a rudder to be combined with a carrier.

As shown in FIG. 7, the through hole 53*a* (63*a*, 73*a*) is formed apart from the center point of the rudder 53 (63, 73) having an oval-like cross-section encircled with two symmetrically opposed sidewalls, whose curvature is almost equal to that of the circular opening C1 (C2), and a middle width is slightly narrower than that of the cam track 5 (6) to be smoothly guided by the cam tracks 5 and 6. The rudder 53 (63, 73) is of an overall length slightly greater than the distance between the intersection points of two circular openings C1 and C2 such that the rudder is to be laid across one cam track 5 and the other cam track 6 at the crossover point of the figure '8' track. It is preferable to form the through hole 53*a* (63*a*, 73*a*) in the rudder 53 (63, 73) such that the distance between centers of the through hole 53*a* (63*a*, 73*a*) and the rudder 53 (63, 73) is longer than the radius of the through hole 53*a* (63*a*, 73*a*).

The rudder 53 (63, 73) is supported on the carrier shaft 51 (61, 71) inserted into the through hole 53*a* (63*a*, 73*a*) thereof in such a manner that the front portion ahead of the through hole 53*a* (63*a*, 73*a*) is shorter than the rear. When the rudder 53 (63, 73) passes through the horizontal centerline 'O' of the two circular openings C1 and C2 from the left cam track 5, the protrusion 12*a* of the cam 12 pushes the rudder 53 (63, 73) at one side to make the front portion of the rudder 53 (63, 73) enter the right cam track 6 in diagonal direction until the carrier 50 (60, 70) being guided by the rudder 53 (63, 73) is fully taken over from the left recess 32*a* formed in the left finger 32 to the right recess 42*a* formed in the right finger 42. Therefore, the carrier 50 (60, 70) gets a smooth figure eight motion around the crossover point as well as along the normal circular cam track. The rudder 53 (63, 73) has a thickness 't' slightly, for example, about 3/100 mm, thicker than the thickness 'd' of the guide plate 4 to keep the bottom surface of the holder 54 (64, 74) not in contact with the upper surface of the guide plate 4 while the holder 54 (64, 74) moves along the '8'-shaped track.

As the rudder 53 (63, 73) has the above mentioned configuration, the carrier 50 (60, 70) seated in one of the recesses 32*a* of the left finger 32 travels along the one cam track 5 counterclockwise according to the guidance of the rudder 53 (63, 73) whose sidewall shape is fitted to the outer periphery of the cam track. When the rudder 53 (63, 73) passes through the horizontal centerline 'O' of the two circular openings C1 and C2, it is pushed by the protrusion 12*a* of the one cam 12 so that its motion is turned from circular motion to straight toward the other cam track 6. Therefore, the carrier 50 (60, 70) whose traveling direction is guided by the rudder 53 (63, 73) enters the other cam track 6 and travels along the other cam track 6 clockwise. This gives a '8' track motion to all the carriers 50, 60, and 70. The pocket recessed in the holder 54 (64, 74) of the carrier 50 (60, 70) has a magnetic plate 55 (65, 75) on the bottom so that the hair grabbing member 100 may be inserted and detachably held therein. Preferably, the carrier 50 (60, 70) may be wholy made of magnetic material.

Figure 8:
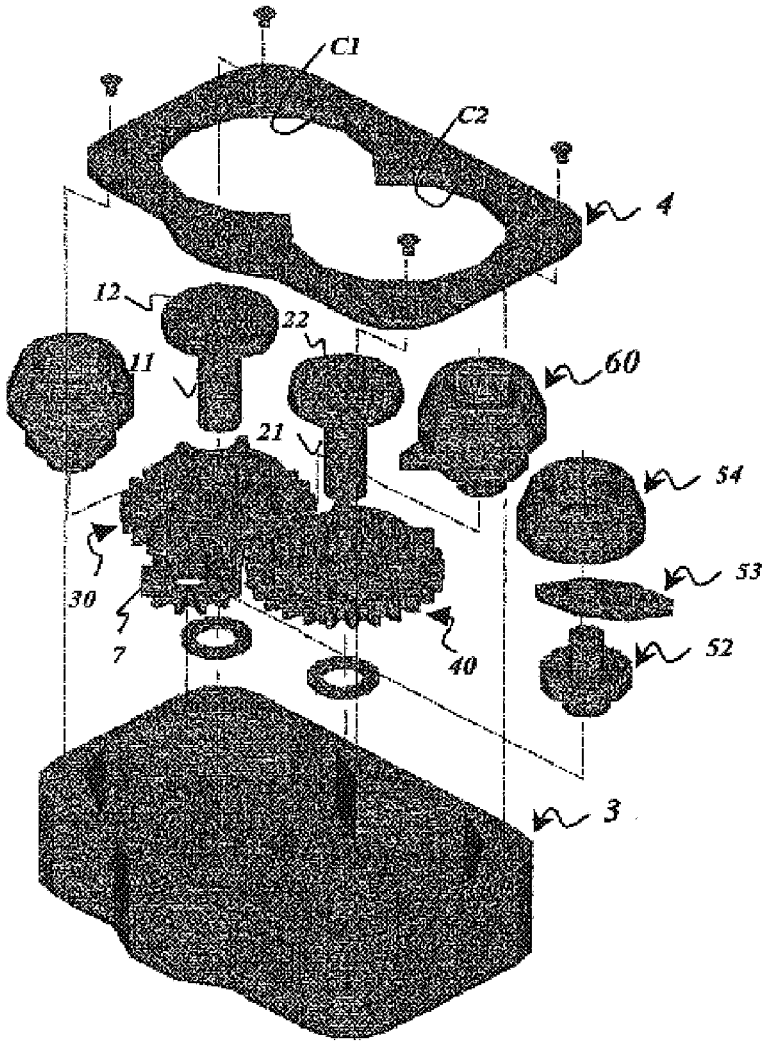
FIG. 8 is an exploded view of a driving member of the hair braider according to the present invention.

FIG. 8 shows an exploded view for the gear box assembly of the present invention.

Figure 1B:
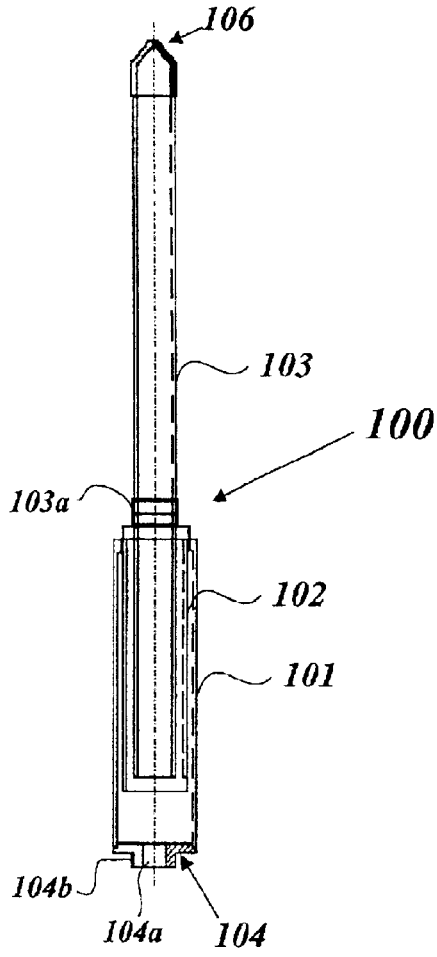
FIG. 1B is a longitudinally sectional view of the hair grabbing tube assembly folded telescopically.

As shown in FIGS. 1A and 1B, the hair grabbing member 100 includes tree telescopically-assembled tubes 101, 102, and 103, each tube being made of transparent material and long and wide enough to contain a bunch of hair. The number of tubes constituting the hair grabbing member 100 may be increased to accommodate longer hair. As the tube is transparent, the operator can see whether or not the hair is coiled and seated well in the tubes before or during braiding.

The lower tube 101 is of the largest inner diameter to accommodate the middle tube 102 and the upper tube 103 telescopically and includes a metal ring 104 fixed on the bottom. The metal ring 104 has a central hole 104*a* to pass through a needle member described below. The ring 104 has a boss portion 104*b* formed around the central hole 104*a* on the bottom surface to be attached to the magnetic plate 55 (65, 75) of the pocket of the holder 54 (64, 74).

Figure 9:
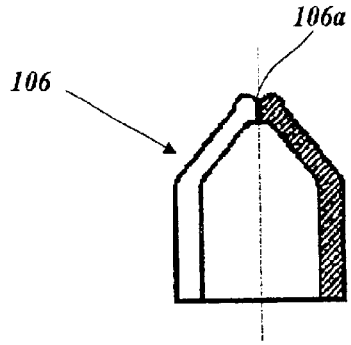
FIG. 9 is a partially sectional side view of a cap to be covered onto an upper tube of the hair grabbing member.

The upper tube 103 is made of a flexible plastic. While the bunches of hair accommodated in three upper tubes 103 are pulled out, they get closer to braiding point, which causes a lateral force applied to their upper tubes 103. As the upper tube 103 is flexible, it is elastically bent over and absorbs the lateral force. The upper end of the upper tube 103 is covered with a cap 106. As shown in FIG. 9, the cap 106 is preferably made of an elastic rubber to hold a bunch of hair tightly through the central nozzle 106*a*. The cap 106 is replaceable with another one having the nozzle 106*a* of different diameter appropriate to the thickness of a bunch of hair.

The upper tube 103 may get longer with an extending tube of the same diameter connected thereto by means of a connecting ring 103*a* to allow longer hair to line up. In this case, the extending tube is preferably made of hard plastic as the middle tube 102 and the lower tube 101 are.

Preferably, the gap D1 (D2) between the diameter of entering hole and inner diameter of the tube 102 (103) is given much wider than the thickness of a string of hair to prevent ends of hair from being caught in the gap D1 (D2) when a bunch of hair is twisted or circulated in the tubes due to the figure '8'-track motion of each hair grabbing member 100.

As shown in FIG. 1B, the middle tube 102 has upper end of a slightly larger outer diameter than entering hole of the lower tube 101 or is longer than the lower tube 101 to prevent from entering into the lower tube 101 completely. The connecting ring 103*a* of the upper tube 103 also performs the same function when all tubes are folded.

Figure 10:
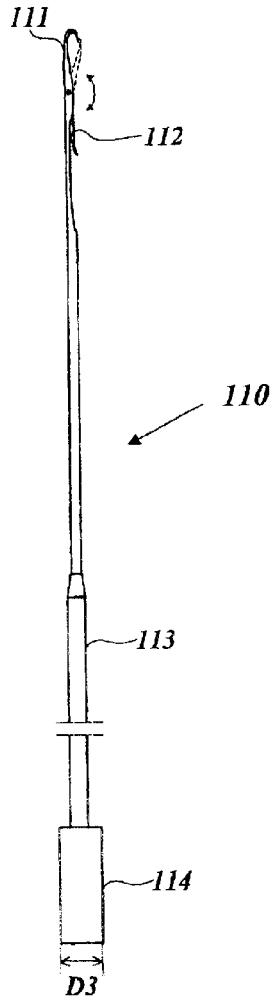
FIG. 10 is a side view of a needle member for grabbing a bunch of hair.

The present invention includes a needle member 110 as an auxiliary device, which hooks a bunch of hair with a hook 111 and passes through the tubes 101, 102, and 103 successively to pull the bunch of hair into the tubes of the hair grabbing member 100. As shown in FIG. 10, the needle member 110 comprises a slender body 113, a hook 111 having an opening at back side, a rotating pin 112 pivoted on the bottom of the hook 111 to close or open the opening of the hook 111, and a grip portion 114 of a larger diameter 'D3' than the center hole 104*a* of the metal plate 104 of the lower tube 101 to grasp easily and to prevent the needle member 110 from entering entirely into the lower tube 101.

An embodiment according to the present invention operates as follows.

The needle member 110 passes through the three tubes 101, 102, and 103 retracted as shown in FIG. 1B and the cap 106 successively until the hook 111 protrudes out of the cap 106 with the rotating pin 112 opened. While the needle member 110 is being pulled down through the central nozzle 106*a* of the cap 106 with a bunch of hair caught by the hook 111, the hook 111 tightly holds and draws a bunch of hair into the tubes 101, 102, and 103. When the hook 111 arrives at the entrance of the nozzle 106*a*, the rotating pin 112 closes the back opening of the hook 111 to slide the hook 111 with the hair hooked through the nozzle 106*a*.

After that, the tubes 101, 102, and 103 are extended telescopically, and a bunch of hair has been accommodated into the unfolded tubes 101, 102, and 103 with the bunch of hair clamped by the elastic force of the nozzle 106*a* of the cap 106. Three hair grabbing members 100 hold three bunches of hair respectively through the above operation and then are seated on the three holders 54, 64, and 74 firmly by a magnetic force interacting between the metal rings 104 and the magnetic plates 55, 65, and 75.

While the three hair grabbing members 100 conduct the '8' track motion by the driving member 200, they braid three bunches of hair into one strand. As three carriers 50, 60, and 70 perform the same track motion, only one carrier motion will be explained hereinafter.

When the motor 1 is turned on with the switch 1*b* on, it drives the driving gear 7 connected to its shaft through the reduction gear and rotates a couple of the driven gears 31 and 41 in opposite direction. For example, if the left driven gear 31 shown in FIG. 5 rotates counterclockwise, the right driven gear 41 rotates clockwise. As the left driven gear 31 rotates counterclockwise, the left finger 32 also rotates counterclockwise and circulates the cam roller 52, 62, or 72 seated in one of the recesses 32*a* and the carrier 50, 60, or 70 connected to the corresponding cam roller along the cam track.

At this time, the rudder 53, 63, or 73 travels along the left cam track 5 with the one sidewall in contact with outer sidewall of the cam track 5, thereby guiding the carrier 50, 60, or 70 along the half of the figure '8' track. The holder 54, 64, or 74 of the carrier 50, 60, or 70 carrying the hair grabbing members 100 conducts the same track motion.

When the rudder 53, 63, or 73 passes through the perpendicular intersection line 'H' from the left cam track 5, it is pushed by the protrusion 12*a* of the left cam 12 at the pressure angle of 23 degrees with respect to the intersection line 'H' so that it turns toward the right cam track 6. At the same time, the cam roller 52, 62, or 72 under the rudder 53, 63, or 73 moves into one of the recesses 42*a* of the right finger 42 rotating clockwise and is then carried by one of the right recesses 42*a*.

As the carrier shaft 51, 61, or 71 inserted into the through hole 53*a*, 63*a*, or 73*a* is placed at the leading portion apart from the center point of the rudder 53, 63, or 73, the carrier shaft 51, 61, or 71 is already positioned on the right circulating path of the left recesses 42*a* just when the rudder 53, 63, or 73 is positioned across the left cam track 5 and the right track 6. That is, the rudder 53, 63, or 73 keeps on moving along the right cam track 6 after the carrier shaft 51, 61, or 71 passes over the intersection line 'H', thereby changing motion track smoothly at the intersection area of the '8'-shaped track.

On the other hand, the rudder 53, 63, or 73 traveling clockwise along the right cam track 6 passes through the perpendicular intersection line 'H', it is also pushed by the protrusion 22*a* of the right cam 22 and turns toward the left cam track 5. At the same time, the cam roller 52, 62, or 72 under the rudder 53, 63, or 73 moves into one of the recesses 32*a* of the left finger 32 rotating counterclockwise.

As described above, the '8' track motion of three carriers 50, 60, and 70 provides the same track motion to the three hair grabbing members 100 combined with three carriers 50, 60, and 70 at the holders 54, 64, and 74, which makes three bunches of hair accommodated in the three hair grabbing members 100 be braided into one strand as the bunches of hair in the hair grabbing members 100 are pulled out inch by inch from the tubes through the nozzles 106*a* clamping the bunches of hair.

The foregoing is provided only for the purpose of illustration and explanation of the preferred embodiments of the present invention, so changes, variations and modifications may be made without departing from the spirit and scope of the invention.

What is claimed is:

1. An auxiliary device for a hair braider, comprising:

a plurality of cylindrical tubes assembled telescopically each other, wherein the lower tube has a metal ring with a center hole on the bottom, the upper tube is covered with an elastic cap for clamping a bunch of hair through a nozzle on the top thereof, and the diameter of an entrance hole of each upper end of all tubes except the upper tube is slightly smaller than inner diameter of the tube.

2. An auxiliary device according to claim 1, wherein said upper tube is formed of a soft plastic to be flexible and the other tubes are formed of a hard plastic.

3. An auxiliary device according to claim 1, wherein the difference between the diameter of entrance hole and inner diameter of the lower tube is greater than that of the other tubes.

4. An auxiliary device according to claim 1, wherein said cap is replaceable with another cap with a nozzle of different diameter fitted to the thickness of a bunch of hair therein.

5. An auxiliary device according to claim 1, wherein said metal ring has a boss around the center hole.

6. An auxiliary device according to claim 1, further including a slender needle member comprising a hook engaging a bunch of hair, a rotating pin pivoted on the root of the hook to close or open the hook.

* * * * *